US008130989B2

(12) United States Patent
Latzel

(10) Patent No.: US 8,130,989 B2
(45) Date of Patent: Mar. 6, 2012

(54) GENDER-SPECIFIC HEARING DEVICE ADJUSTMENT

(75) Inventor: Matthias Latzel, Eggolsheim (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1165 days.

(21) Appl. No.: 11/899,549

(22) Filed: Sep. 6, 2007

(65) Prior Publication Data

US 2009/0154745 A1 Jun. 18, 2009

(30) Foreign Application Priority Data

Sep. 7, 2006 (DE) ..... 10 2006 042 084

(51) Int. Cl.
*H04R 25/00* (2006.01)

(52) U.S. Cl. ..... 381/314; 381/60; 381/68; 381/312; 73/585

(58) Field of Classification Search ..... 381/60, 381/68, 312, 314; 73/585
See application file for complete search history.

(56) References Cited

U.S. PATENT DOCUMENTS

| | | | | |
|---|---|---|---|---|
| 5,606,620 | A * | 2/1997 | Weinfurtner | 381/314 |
| 2004/0141626 | A1* | 7/2004 | Basseas | 381/314 |
| 2004/0204659 | A1 | 10/2004 | John et al. | |
| 2005/0192514 | A1 | 9/2005 | Kearby et al. | |
| 2006/0093997 | A1 | 5/2006 | Kearby et al. | |

FOREIGN PATENT DOCUMENTS

DE 100 05 428 A1 8/2001

OTHER PUBLICATIONS

Deanna S. Rogers, The influence of Listener's Gender on the Acceptance of Background Noise, Sep. 2003, Journal of the American Academy of Audiology, p. 372-382.*

Gary Davis, Ralph Jones, The sound reinforcement handbook, Jun. 1989, Hal Leonard Corporation, Edition 2, p. 31.*

Smeeth et al., "Reduced hearing, ownership, and use of hearing aids in elderly people in the UK-the MRC trial of the Assessment and Management of older people in the community: a cross-sectional survey", Apr. 2002, pp. 1466-1470, The Lancet, vol. 359.

Rogers et al., The Influence of Listener's Gender on the Acceptance of Background Noise, Journal of the American Academy of Audiology, 2003, pp. 372-382, vol. 14, No. 7.

(Continued)

*Primary Examiner* — Steven Loke
*Assistant Examiner* — Cuong Nguyen

(57) ABSTRACT

The spontaneous acceptance by a hearing device wearer in respect of a new hearing device is to be improved. To this end, a method for adjusting the amplification of a hearing device to an individual hearing device wearer is proposed, with which a target amplification for the hearing device wearer is determined on the basis of his/her hearing loss. Data relating to the gender of the hearing device wearer is provided in order to improve the adjustment. The target amplification is then also determined on the basis of the gender of the hearing device wearer. With the gender-specific target amplification, it is possible for instance to take account of the fact that women exhibit a more sensitive perception for average voice levels than men, thereby allowing the target amplification to correspondingly drop much lower.

12 Claims, 1 Drawing Sheet

OTHER PUBLICATIONS

Davis, et al., Written for Yamaha, "Sound Reinforcement Handbook", Second Edition, Jun. 1989, pp. 1-31, Published by Hal Leonard Corporation, ISBN 0-88188-900-8.

Decker, "The effects of informative and non-informative speech on the judgment of most comfortable listening level", Journal of the American Auditory Society, Jul.-Aug., 1978, pp. 16-8, vol. 4, No. 1.

Hochberg, "Most comfortable listening for the loudness and intelligibility of speech", Audiology. 14, Jan.-Feb. 1975, pp. 27-33, vol. 14, No. 1.

Communication/Invention Disclosure listing cited references, Oct. 31, 2005, pp. 1-3.

* cited by examiner

GENDER-SPECIFIC HEARING DEVICE ADJUSTMENT

CROSS REFERENCE TO RELATED APPLICATIONS

This application claims priority of German application No. 10 2006 042 084.5 filed Sep. 7, 2006, which is incorporated by reference herein in its entirety.

FIELD OF THE INVENTION

The present invention relates to a method for adjusting the amplification of a hearing device to an individual hearing device wearer by determining a target amplification for the hearing device wearer on the basis of his/her hearing loss.

BACKGROUND OF THE INVENTION

Hearing devices are portable hearing apparatuses which are used to supply hearing-impaired persons. To accommodate the numerous individual requirements, different configurations of hearing devices such as behind-the-ear hearing devices (BTE), in-the-ear hearing devices (ITE), concha hearing devices, are provided. The hearing devices designed by way of example are worn on the outer ear or in the auditory canal. Furthermore, bone conduction hearing aids, implantable or vibrotactile hearing aids are also available on the market. The damaged ear is herewith either stimulated mechanically or electrically.

Essential components of the hearing devices include in principal an input converter, an amplifier and an output converter. The input converter is generally a receiving transducer, e.g. a microphone and /or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. This basic configuration is shown in the example in FIG. 1 of a behind-the-ear hearing device. One or more microphones 2 for recording the ambient sound are incorporated in a hearing device housing 1 to be worn behind the ear. A signal processing unit 3, which is similarly integrated into the hearing device housing 1, processes the microphone signals and amplifies them. The output signal of the signal processing unit 3 is transmitted to a loudspeaker and/or receiver 4, which outputs an acoustic signal. The sound is optionally transmitted to the ear drum of the device wearer via a sound tube, which is fixed with an otoplastic in the auditory canal. The power supply of the hearing device and in particular of the signal processing unit 3 is carried out by a battery 5 which is likewise integrated into the hearing device housing 1.

Previously many parameters of the hearing-impaired person have been adopted during the calculation of the target amplification by means of a corresponding adjusting software. Examples of parameters of this type are audiograms, discomfort thresholds, auditory sensitivity, age, usage etc.

Some psychoacoustic studies indicate that men and women perceive sound differently. In the superthreshold range, the loudness of a sound is perceived in a subjectively different manner depending on the gender. Studies of this type are for instance:

Deanna S. Rogers et al.: The influence of listener's gender on the acceptance of background noise. Journal of AAA, Volume 14, No. 7; 2003; Decker T N: The effects of informative and non-informative speech on the judgment of most comfortable listening level. J Am Audiol Soc, 4:16-18; 1978; Hochberg I: Most comfortable listening for the loudness and intelligibility of speech. Audiol, 14:17-33; 1975.

The publication DE 100 05 428 A1 discloses an apparatus for adjusting programmable hearing devices. This apparatus contains a computer, which is connected to the hearing device for data exchange purposes by way of an interface. The computer is connected to an additional input apparatus by way of a further interface, said input apparatus being configured for direct operation by the hearing device wearer.

The publication US 2004/0204659 A1 describes a system and a method for objectively determining the hearing ability with the aid of stationary auditory responses. A database is included there, which contains age- and gender-specific phase delay values for different stimuli.

The further publication US 2005/0192514 A1 discloses an audiological treatment system, in particular for the treatment of tinnitus. Prior to the treatment, a patient profile with the gender, age, career, insurance company and previous illnesses is recorded.

SUMMARY OF THE INVENTION

The object of the present invention thus consists in improving the spontaneous acceptance by a hearing device wearer in respect of an individually adjusted hearing device.

This object is achieved in accordance with the invention by a method for adjusting the amplification of a hearing device to an individual hearing device wearer by determining a target amplification for the hearing device wearer on the basis of his/her hearing loss, with data relating to the gender of the hearing device wearer being provided and the target amplification also be determined on the basis of the gender of the hearing device wearer.

The idea underlying the invention is that the spontaneous acceptance is essentially affected by the subjective auditory sensitivity. During the calculation of the target amplification for hearing device adjustment purposes, the gender of the hearing-impaired person is hence advantageously taken into consideration, as a result of which the gender-specific auditory sensitivity is also included in the target amplification.

The data relating to the gender of the hearing device wearer can be provided in a database and automatically read out. This also allows the hearing device to be automatically adjusted for numerous hearing device wearers.

Alternatively, the data relating to the gender of the hearing device wearer can be provided by manually inputting onto a user interface. This enables account to be taken into the gender of the hearing device wearer independent of databases and individual adjustment by means of an acoustician and/or audiologist.

One of a number of predetermined prescriptive adjustment methods is preferably selected on the basis of the hearing device type and/or hearing device wearer in order to determine the target amplification. It is thus possible to account for the individual conditions of a hearing device wearer in a more effective manner.

The target amplification in the level range of the MCL (Most Comfortable Level) can in particular be selected lower for women than for men. Allowances can thus be made for the fact that women exhibit a more sensitive perception to average voice levels.

Furthermore, the target amplification in the level range of the discomfort threshold, i.e. the UCL (Uncomfortable Level)

can also be selected lower for women than for men. This takes account of the fact that women are also more sensitive to loud input levels than men.

BRIEF DESCRIPTION OF THE DRAWINGS

The present invention is described in more detail with reference to the appended drawings, in which.

DETAILED DESCRIPTION OF THE INVENTION

The exemplary embodiment illustrated in more detail below represents a preferred embodiment of the present invention.

With the adjustment of a hearing device 10 to an individual hearing device wearer, the target amplification, which the amplification unit of the signal processing unit of the hearing device 10 has to achieve, is to be determined as a function of the audiogram and numerous other parameters. The calculation of the target amplification 11 is based on the rules of a prescriptive adjustment method. An acoustician selects a suitable adjustment method as a function of the hearing device type and/or model. By way of example, hearing device manufacturers provide an individual adjustment method for their hearing devices in each instance.

Provision is now made in accordance with the invention that with the selection of the prescriptive adjustment method, the gender of the hearing-impaired person is requested and/or input. This information allows the calculation of the target amplification 11 to supply a gender-specific result, which is transmitted to the hearing device 10 and/or its signal processing.

Figure 1:
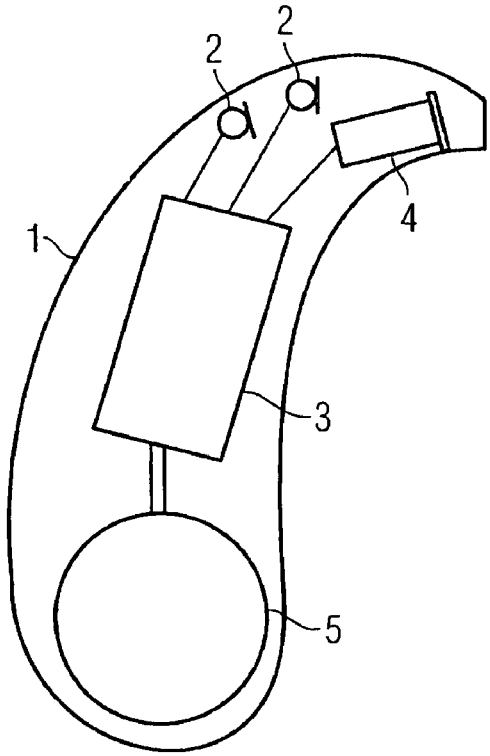
FIG 1 (Prior art)
FIG. 1 shows a schematic diagram of the electronic setup of a hearing device and FIG. 2 shows a drawing to illustrate the adjustment method according to the invention in consideration of the gender of the hearing device wearer.
Figure 2:
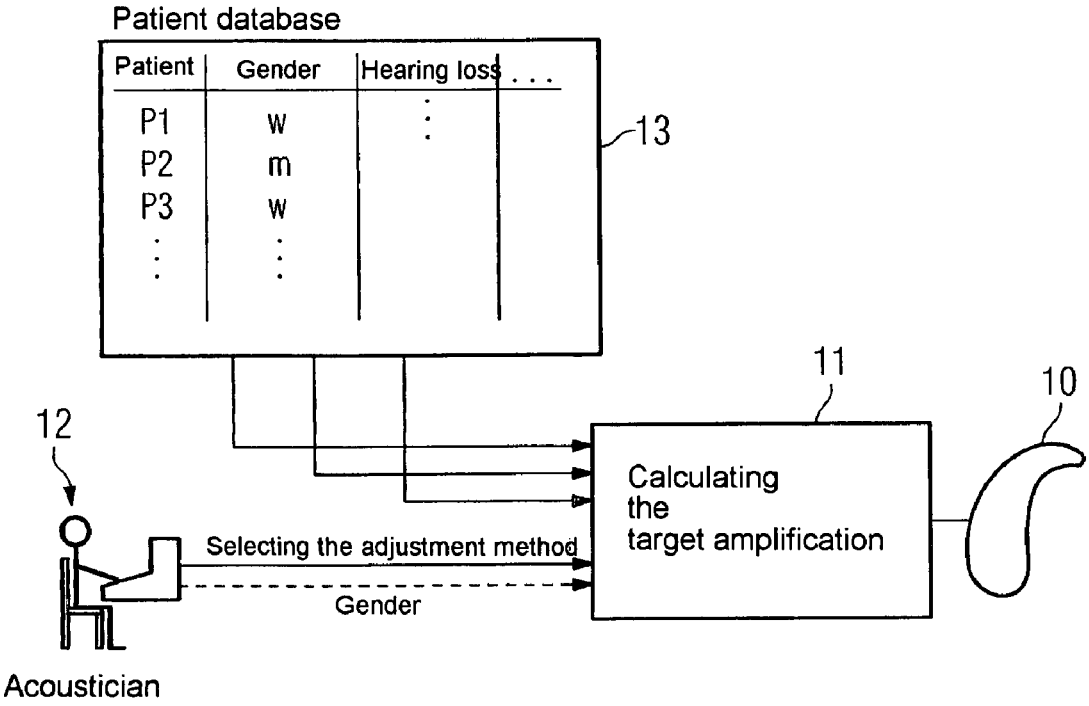

The information relating to the gender of the hearing-impaired person can be taken from a patient database 13. This database 13 can also provide additional information for the calculation of the target amplification 11 for automatic readout. Alternatively, the gender of the hearing-impaired person can also be manually input, for instance by means of the acoustician 12. This is shown in FIG. 2 by way of a dashed arrow.

It has proven favorable to set the amplification for average voice levels somewhat lower with women than with men. The same applies to estimating the amplification for very loud input levels in the region of the discomfort threshold, because women also have a more sensitive perception here. This can thus ensure that the gender-specific residual dynamic range resulting therefrom is also considered during the adjustment.

Thus binary information relating to the gender of the hearing-impaired person is sufficient for the adjustment software to determine a gender-specific target amplification. This gender-specific hearing device amplification improves the spontaneous acceptance by the hearing device wearer in respect of a new hearing device. Consequently, the hearing-impaired person can become more quickly accustomed to the calculated amplification and can benefit from the advantages of being provided with a hearing device.

The invention claimed is:

1. A method for determining an amplification of a hearing device with respect to an individual hearing device wearer, comprising:

calculating via adjusting software on a computing device a target amplification for the individual hearing device wearer based on the individual wearer's hearing loss;

receiving via the computing device a gender data of the individual hearing device wearer;

prior to individual adjustment of the hearing device based on a subjective sensitivity of the hearing device wearer, further adjusting the target amplification for sensitivity via the computing device by calculating a gender-specific target amplification based on gender-specific auditory sensitivity data for the gender data of the individual hearing device wearer, wherein the gender-specific auditory sensitivity data comprises different amplification levels for a plurality of level ranges as a function of gender; and transmitting the gender-specific target amplification to the hearing device, thereby improving acceptance by the hearing device wearer based on the target amplification for sensitivity.

2. The method as claimed in claim 1, wherein the gender data for the individual hearing device wearer is stored in a database and is automatically read out via the computing device.

3. The method as claimed in claim 1, wherein the gender data for the individual hearing device wearer is provided by receiving a manual input into a user interface of the computing device.

4. The method as claimed in claim 1, wherein the target amplification is adjusted by a predetermined prescriptive adjustment method based on a type of the hearing device.

5. The method as claimed in claim 1, wherein the gender-specific target amplification in a level range of most comfortable level (MCL) is selected based on gender to be less for a female gender than for a male gender.

6. The method as claimed in claim 1, wherein the gender specific target amplification in a level range of uncomfortable level (UCL) is selected based on gender to be less for a female gender than for a male gender.

7. A device for determining an amplification of a hearing device with respect to an individual hearing device wearer, comprising:

a computing unit in communication with a hearing device, the computing unit configured to:

calculate a target amplification for the individual hearing device wearer based on the individual wearer's hearing loss;

receive a gender data of the individual hearing device wearer;

prior to individual adjustment of the hearing device based on a subjective sensitivity of the hearing device wearer, further adjust the target amplification for sensitivity by calculating a gender-specific target amplification based on gender-specific auditory sensitivity data for the gender data of the individual hearing device wearer, wherein the gender-specific auditory sensitivity data comprises different amplification levels for a plurality of level ranges as a function of gender; and transmit the gender-specific target amplification to the hearing device, thereby improving acceptance by the hearing device wearer based on the target amplification for sensitivity.

8. The device as claimed in claim 7, further comprising a storage unit that stores a gender data of the individual hearing device wearer, wherein the gender data for the individual hearing device wearer is stored in the storage unit and is automatically read out via the computing unit.

9. The device as claimed in claim 7, wherein the gender data for the individual hearing device wearer is provided by receiving a manual input into a user interface of the computing unit.

10. The device as claimed in claim 7, wherein the target amplification is adjusted by a predetermined prescriptive adjustment method based on a type of the hearing device.

11. The device as claimed in claim 7, wherein the gender-specific target amplification in a level range of most comfortable level (MCL) is selected based on gender to be less for a female gender than for a male gender.

12. The device as claimed in claim 7, wherein the gender-specific target amplification in a level range of uncomfortable level (UCL) is selected based on gender to be less for a female gender than for a male gender.

* * * * *